US005592865A

United States Patent [19]

Lecrone

[11] Patent Number: 5,592,865

[45] Date of Patent: Jan. 14, 1997

[54] SEPARATING ROLLERS FOR A SLICING MECHANISM OF A ROLL SLICING MACHINE

[75] Inventor: Dale S. Lecrone, Jackson, Mich.

[73] Assignee: LeMatic, Inc., Jackson, Mich.

[21] Appl. No.: 368,220

[22] Filed: Jan. 3, 1995

[51] Int. Cl.[6] ..... B26D 3/08

[52] U.S. Cl. ..... 83/872; 83/861; 83/932

[58] Field of Search ..... 83/862, 872, 861, 83/932, 873, 884; 225/94; 99/537, 450.7

[56] References Cited

U.S. PATENT DOCUMENTS

| | | | |
|---|---|---|---|
| 2,669,269 | 2/1954 | Schmidt | 83/873 |
| 2,979,095 | 4/1961 | Jovis | 225/94 |
| 2,987,089 | 6/1961 | Lecrone | 83/873 |
| 3,112,780 | 12/1963 | Lecrone . | |
| 3,911,769 | 10/1975 | Lecrone . | |
| 4,049,171 | 9/1977 | Lecrone . | |
| 4,222,510 | 9/1980 | Kouloumbini et al. | 99/537 X |
| 5,485,772 | 1/1996 | Bastasch et al. | 83/932 X |

*Primary Examiner*—Rinaldi I. Rada
*Assistant Examiner*—Elizabeth Stanley
*Attorney, Agent, or Firm*—Flynn, Thiel, Boutell & Tanis, P.C.

[57] ABSTRACT

A roll slicing mechanism includes a conveyor which moves in a first direction and supports a roll cluster having a pair of joined rolls spaced in a second direction perpendicular to the first direction. A rotatable shaft perpendicular to the conveyor has at an end nearest the conveyor a disk knife parallel to the conveyor, and a roll breaking arrangement spaced opposite the first direction from the shaft in feeding alignment therewith breaks apart a portion of the joint. A spreader arrangement spaced opposite the first direction from the roll breaking arrangement in feeding alignment therewith positions and spreads the rolls of the pair prior to engagement of the rolls with the roll breaking arrangement. In a preferred embodiment, the spreading arrangement includes two rotatably supported wheels oriented to converge toward the conveyor and opposite the first direction, the wheels being supported for movement toward and away from the conveyor and being resiliently urged toward the conveyor.

11 Claims, 6 Drawing Sheets

SEPARATING ROLLERS FOR A SLICING MECHANISM OF A ROLL SLICING MACHINE

FIELD OF THE INVENTION

The present invention relates to a roll slicing mechanism, and more particularly, to a roll slicing mechanism of the type having a rotating disk knife on a shaft and having an arrangement for breaking a portion of a joint between two rolls to facilitate passage of the shaft therebetween during slicing.

BACKGROUND OF THE INVENTION

Machines to slice clusters of rolls by cutting the same inwardly from one side between the top and bottom of the rolls commonly use disk-like knives rotated at high speeds, each knife slicing pairs of connected rolls simultaneously for the major portion of the width of the rolls, thereby leaving a so-called hinge along one unsliced edge of each roll. In order to provide for the passage of the shafts which support the disk-like knives along the joints between the upper portions of the rolls to be sliced, different techniques have been utilized.

One early technique was to employ a vertical knife which partially sliced adjoining rolls in a cluster, substantially along the joint between the rolls, the vertical knife being positioned ahead of the horizontal slicing knives. Normally, the vertical slicing knives were arranged to slice downwardly from the top of the cluster of rolls to a depth approximately midway between the top and bottom of the rolls, to thereby provide clearance for the shafts of the horizontal slicing knives when the rolls containing the partial vertical slits reached the knives. One example of this type of machine is disclosed in expired U.S. Pat. No. 3,112,780, the inventor of which is the same inventor named in the present application.

Thereafter, machines were developed using a different approach to provide for passage of the shafts of the knives. In particular, instead of a knife, a roll breaking arrangement was provided ahead of the horizontal slicing knives to break apart the pair of rolls along the joint between them and above the slice made by the knife, in order to provide clearance between the rolls for passage of the shaft of the knife. This roll breaking arrangement typically has a pair of rotating spindles with adjacent lower ends which each have a chisel-like shape. Examples of machines of this type are disclosed in expired U.S. Pat. Nos. 3,911,769 and 4,049,171, each of which was invented by the same inventor named in the present application.

While all of these prior approaches have been generally adequate for their intended purposes, they have not been satisfactory in all respects. For example, if a joint between two rolls was not in proper traverse alignment with the vertical knife or the roll breaking arrangement, the vertical knife or roll breaking arrangement would tend to cut or tear an edge portion of one of the rolls, instead of cutting just the joint between the rolls.

Accordingly, one object of the present invention is to provide a roll slicing mechanism which is capable of accurately and reliably positioning the joint between two rolls in accurate traverse alignment with a roll breaking mechanism such as a vertical knife or rotating spindles, while spreading the rolls prior to engagement of the rolls with the knife or roll breaking arrangement in order to substantially eliminate tearing or cutting of the rolls themselves.

SUMMARY OF THE INVENTION

The objects and purposes of the invention, including those set forth above, are met according to one form of the present invention by providing a roll slicing apparatus which includes: a conveyor arrangement for supporting and effecting movement in a first direction of a roll cluster which includes a pair of rolls separably joined at a joint and spaced in a second direction substantially perpendicular to the first direction; a roll slicing arrangement for simultaneously slicing the rolls of the pair between tops and bottoms thereof, including a rotatably supported shaft extending in a third direction substantially perpendicular to the first and second directions and having at an end nearest the conveyor a disk knife extending approximately parallel to the first and second directions; a drive arrangement for effecting rotation of the shaft; a roll breaking arrangement spaced in a fourth direction opposite the first direction from the shaft in feeding alignment with the shaft for breaking apart the pair of rolls along a joint therebetween and above a slice made therein by the knife to provide clearance for passage of the shaft between the rolls; and a spreading arrangement spaced in the fourth direction from the roll breaking arrangement in feeding alignment therewith for urging the rolls of the pair away from each other in directions parallel to the second direction prior to engagement of the roll breaking arrangement with the rolls.

According to a different form of the present invention, a roll slicing apparatus includes: a conveyor arrangement for supporting and effecting movement in a first direction of a roll cluster which includes a pair of rolls separably joined at a joint and spaced in a second direction substantially perpendicular to the first direction; a roll slicing arrangement for simultaneously slicing the rolls of the pair between tops and bottoms thereof, including a rotatably supported shaft extending in a third direction substantially perpendicular to the first and second directions and having at an end nearest the conveyor a disk knife perpendicular to the shaft; a drive arrangement for effecting rotation of the shaft; and a roll breaking arrangement spaced in a fourth direction opposite the first direction from the shaft in feeding alignment with the shaft for breaking apart the pair of rolls along the joint therebetween on a side remote from the conveyor of a slice made in the rolls by the knife in order to provide clearance for passage of the shaft between the rolls, the roll breaking arrangement including a rotatably supported spindle inclined to extend toward the conveyor arrangement and opposite the first direction at an acute angle in the range of 10° to 25° with respect to the third direction when viewed in a direction parallel to the second direction, the drive arrangement including an arrangement for effecting rotation of the spindle, an end of the spindle nearest the conveyor facilitating the breaking of the joint between the rolls.

BRIEF DESCRIPTION OF THE DRAWINGS

A preferred embodiment of the present invention is described in detail hereinafter with reference to the accompanying drawings, in which.

DETAILED DESCRIPTION

Figure 1:
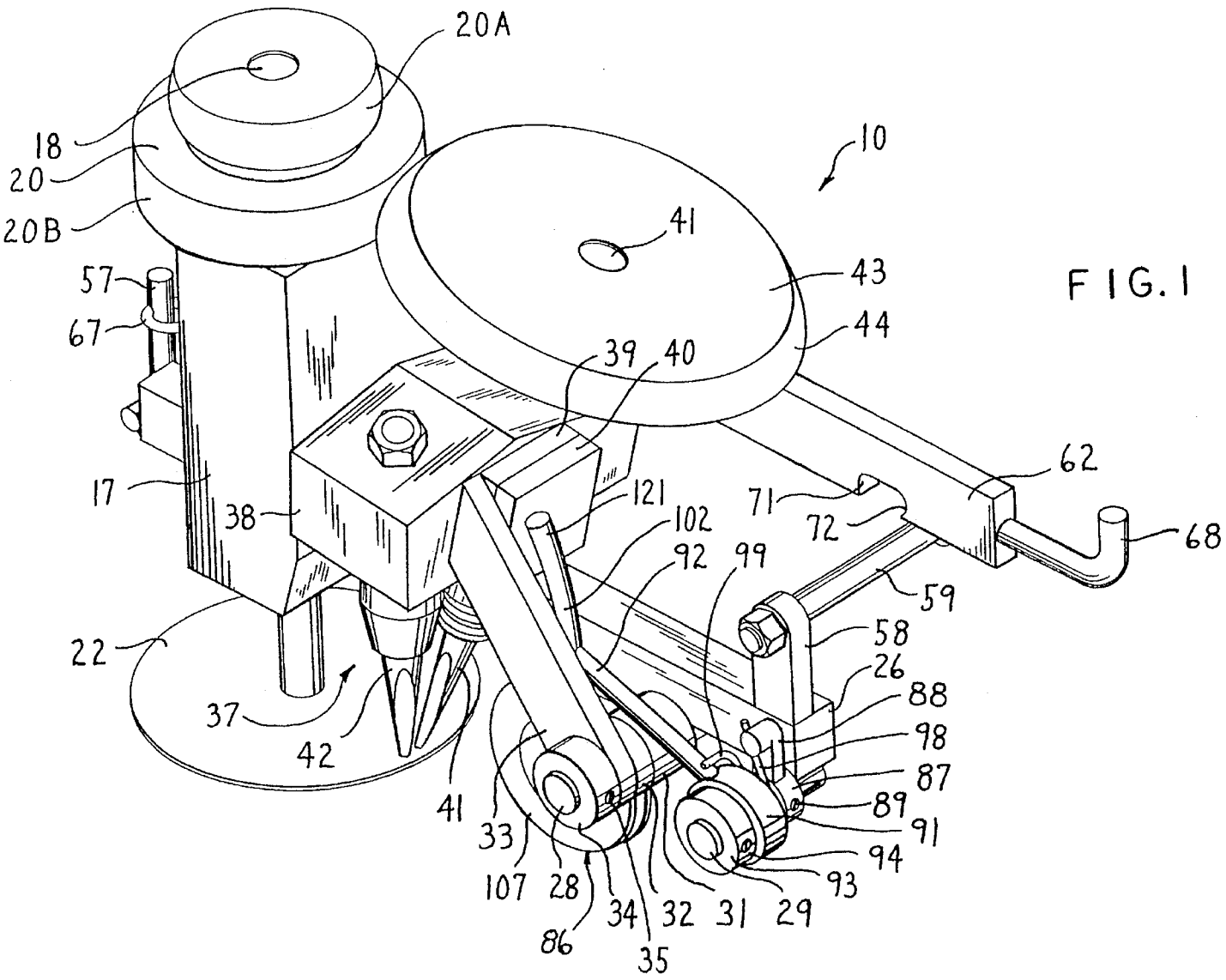
FIG. 1 is a perspective view of a roll slicing mechanism which is part of a roll slicing machine and which embodies the present invention.
Figure 2:
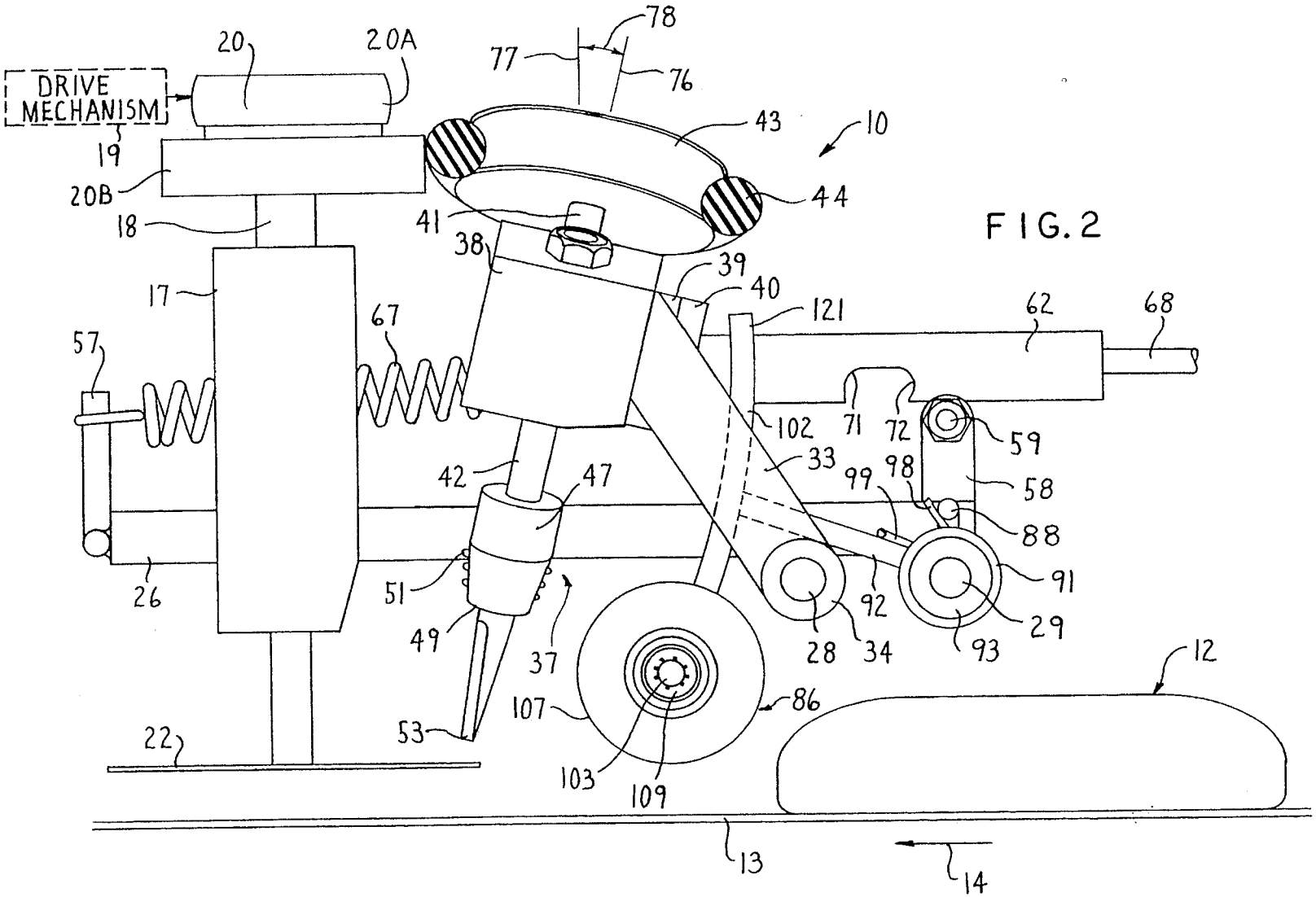
FIG. 2 is an elevational side view of a roll slicing machine which includes the roll slicing mechanism of FIG. 1, the roll slicing mechanism being in an operational position.
Figure 3:
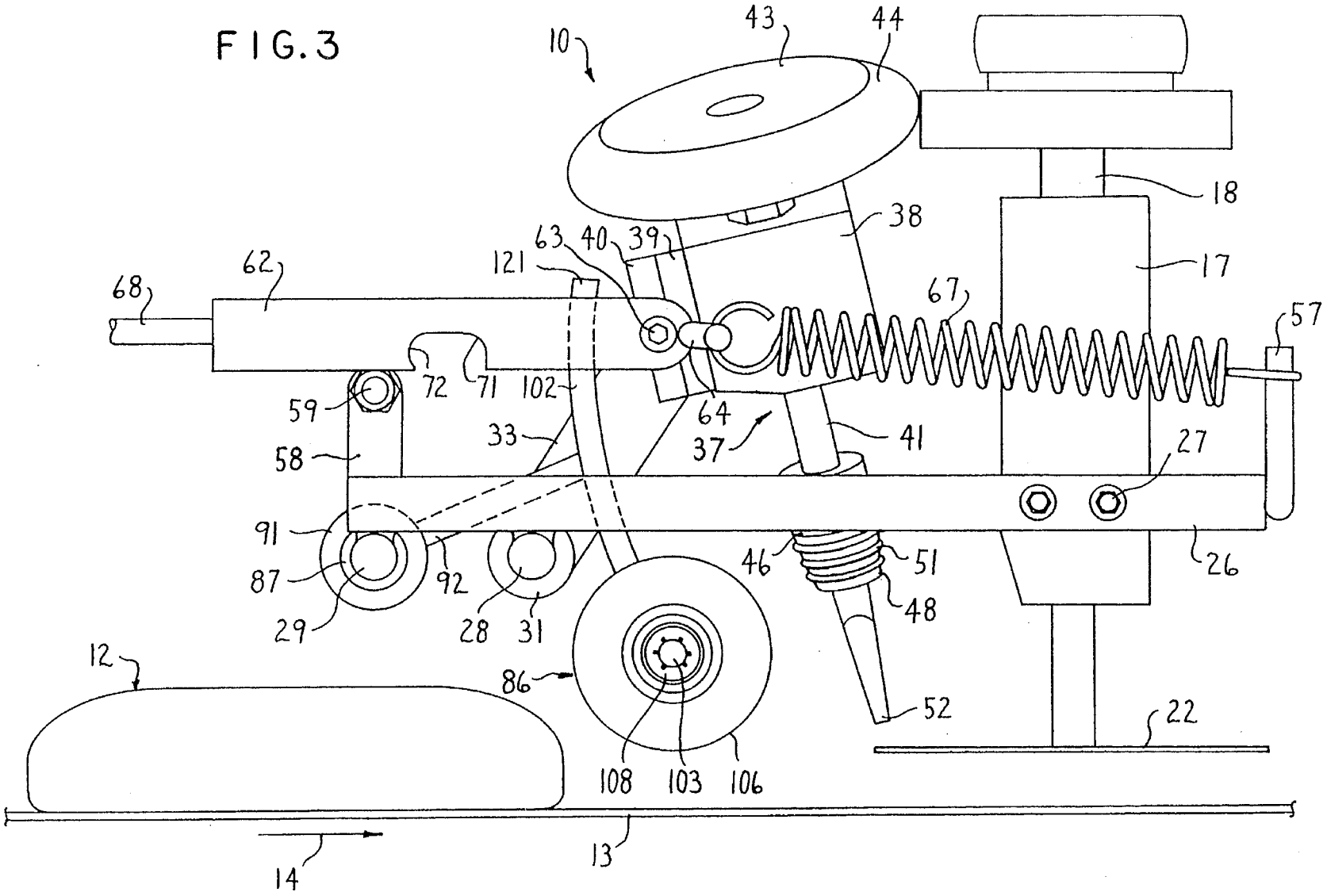
FIG. 3 is an elevational side view of the opposite side of the roll slicing machine of FIG. 2, the roll slicing mechanism being shown in the operational position.

Referring to FIGS. 1–3, reference numeral 10 designates a roll slicing mechanism 10 for a roll slicing machine, the machine including a conventional horizontal conveyor 13 which is moved in a conventional manner in a horizontal conveying direction 14 relative to the roll slicing mechanism 10, while carrying a cluster of rolls 12 to be sliced. The roll cluster 12 may, for example, be a conventional cluster of hot dog buns, and includes at least two adjacent rolls which are offset from each other in a transverse direction perpendicular to the plane of FIGS. 2 and 3, and which are joined at a joint.

The roll slicing mechanism 10 includes a bearing block 17 stationarily mounted on a not-illustrated frame of the machine, and a vertical shaft 18 rotatably supported in the bearing block. The shaft 18 is rotatably driven by a conventional drive mechanism, which is indicated diagrammatically at 19 in FIG. 2, and which in the preferred embodiment includes a moving endless belt (not shown) that engages a disklike portion 20A of a pulley 20 fixedly secured on shaft 18. The pulley 20 has a further disklike portion 20B, for a purpose described below.

Concentrically secured to the lower end of the shaft 18 is a disk knife 22 which is perpendicular to the shaft 18, and which is parallel to the conveyor 13 and the direction 14 of conveyor movement. The shaft 18 and knife 22 are entirely conventional, and are similar to those disclosed in U.S. Pat. Nos. 3,112,780, 3,911,769 and 4,049,171. As a roll cluster 12 on the conveyor passes the knife 22, respective adjacent adjoined rolls pass on opposite sides of the shaft 18, the knife 22 producing simultaneous horizontal slices in the rolls on each side of the shaft 18 at a location approximately midway between the top and bottom of each roll.

A horizontal support bar 26 extends parallel to the direction 14 of conveyor movement and is fixedly secured to the bearing block 17 by two bolts 27 (FIG. 3). A horizontal axle 29 extends transversely of the conveyor perpendicular to the direction 14 of conveyor movement, and is welded to the underside of the support bar 26 at the front end thereof. A short distance along the bar 26 from axle 29 is a further transverse axle 28, which is welded to the underside of bar 26 and extends parallel to the axle 29. The axles 28 and 29 each extend outwardly beyond the bar 26 on one side thereof.

The axle 28 sleeves 31, 32 and 34, and arm 33 comprise a movement support means for movably supporting roll breaking mechanism 37 toward and away from conveyor 13. The axle 28 extends successively through a first sleeve 31 disposed adjacent the bar 26, a further sleeve 32, one end of a radially extending arm 33 which is welded to the sleeve 32, and a sleeve 34 which is fixedly held in place on the axle 28 by a screw stud 35. The sleeve 32 and arm 33 are rotatable on the axle 28, the arm 33 extending generally upwardly and rearwardly from the axle 28.

Figure 5:
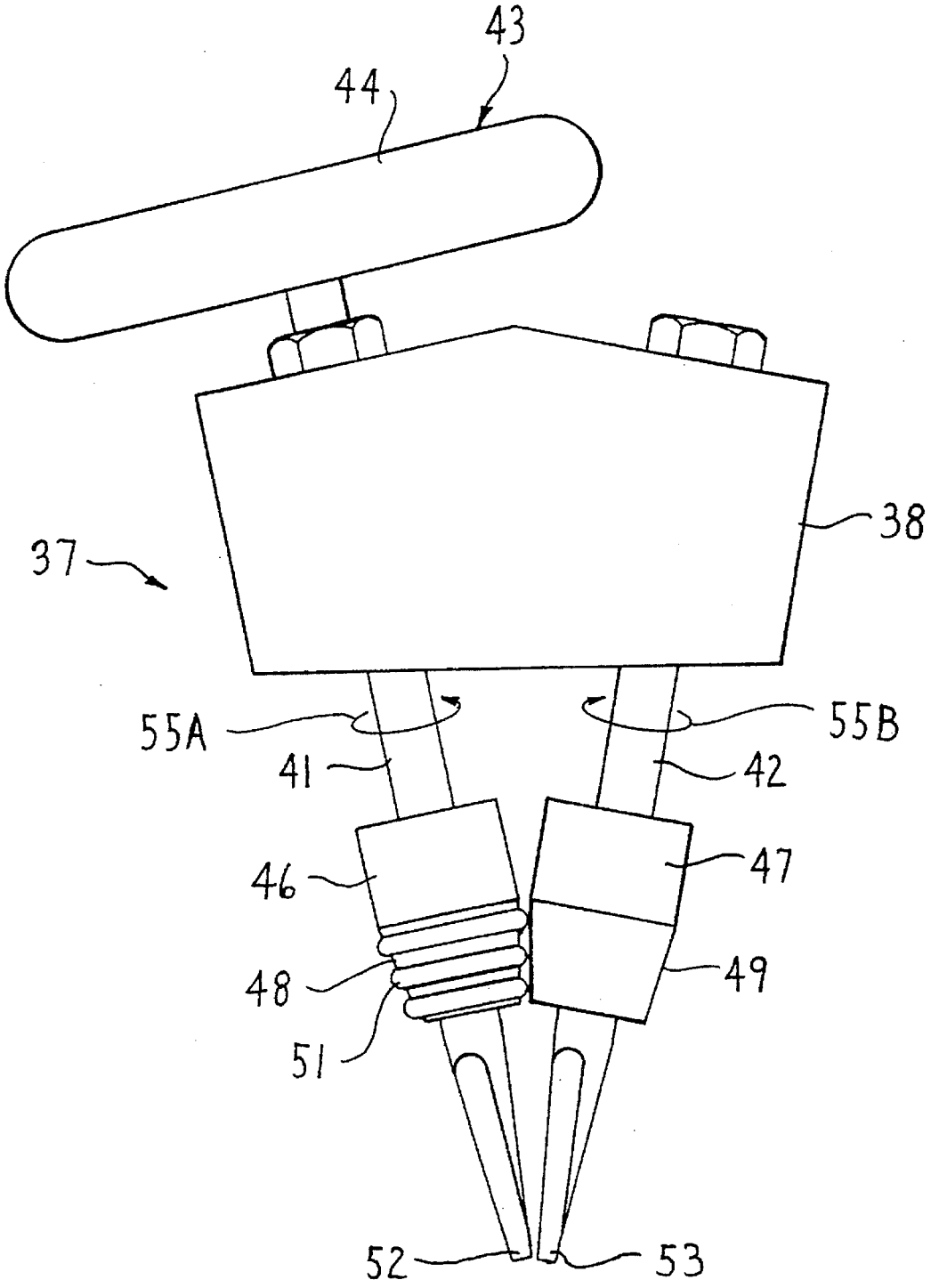
FIG. 5 is an elevational rear view of a roll breaking mechanism which is a component of the roll slicing mechanism of FIG. 1.

The arm 33 has at its upper end a roll breaking mechanism 37, which includes a support block 38 fixedly welded to the upper end of arm 33. Two plates 39 and 40 are welded to the front side of the support block 38 adjacent the arm 33. Referring to FIG. 5, the support block 38 rotatably supports two spindles 41 and 42, which in the rear view of FIG. 5 are angled with respect to each other so as to converge in a downward direction, the lower ends thereof being closely adjacent. A drive wheel 43 is fixedly secured to the upper end of spindle 41, and has a plastic or rubber rim 44 which can frictionally engage the pulley portion 20B as shown in FIG. 1 so that the spindle 41 is rotatably driven by the shaft 18 and pulley 20.

Still referring to FIG. 5, the spindles 41 and 42 have respective hubs 46 and 47 fixedly secured thereon below the support block 38, the hubs 46 and 47 having respective frustoconical surfaces 48 and 49 thereon. The frustoconical surface 48 has three circumferential grooves which each have therein a rubber ring 51, the rubber rings 51 each engaging the frustoconical surface 49 on the hub 47. Thus, when the spindle 41 and hub 46 are being rotated by wheel 43, the rubber rings 51 on the hub 46 effect rotation of the hub 47 and spindle 42. The lower ends 52 and 53 of the spindles 41 and 42 are chisel-shaped, and preferably somewhat resemble the operative end of the bit of a screwdriver. In actual construction, the operative ends 52 and 53 are each approximately ⅛ inch wide and 1/16 inch in thickness. Also, as mentioned above, the operative ends are closely adjacent. It is preferable that, as best seen in FIG. 5, the rubber rings 51 are on the hub 46 which is on the same shaft as the drive wheel 43.

Figure 4:
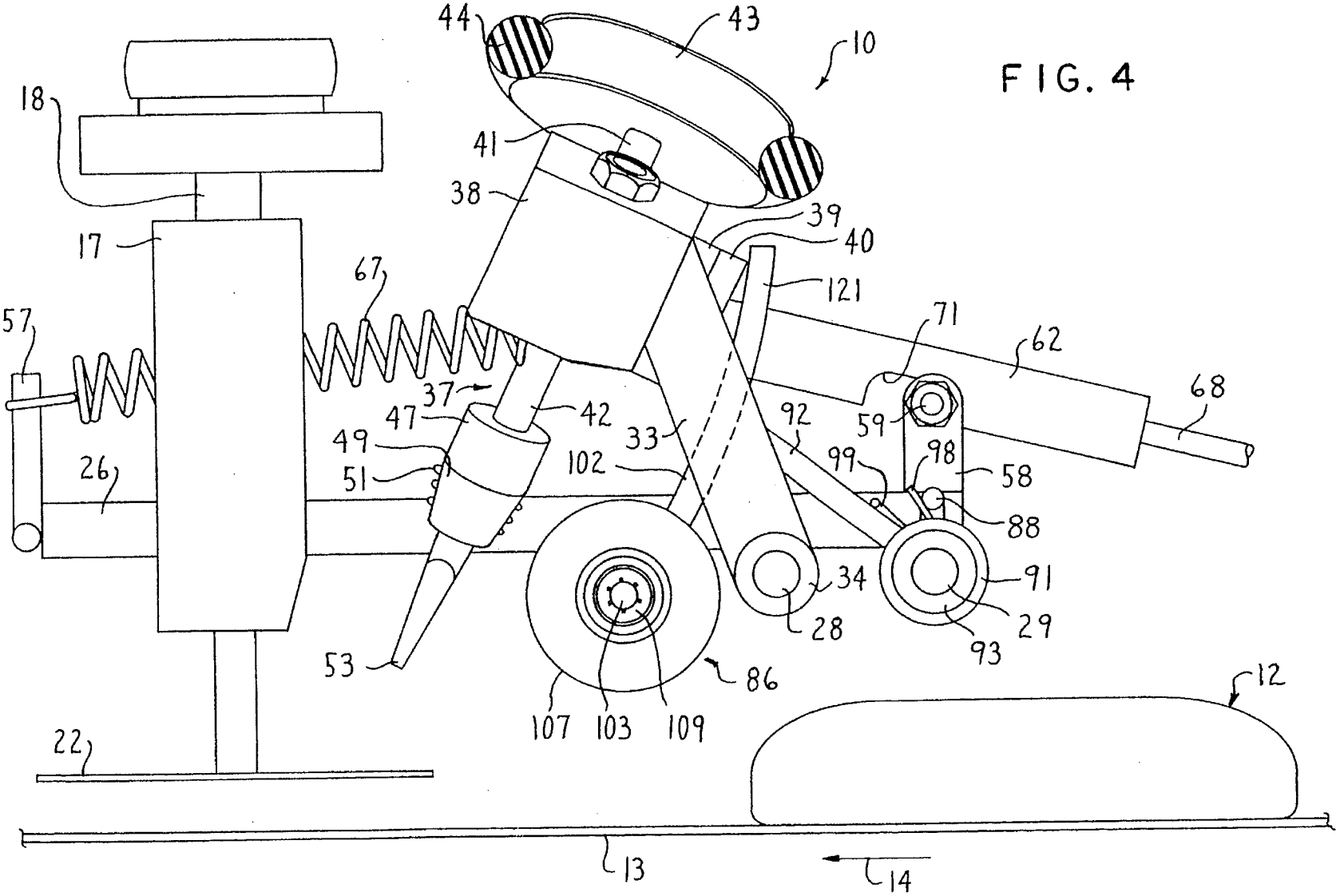
FIG. 4 is an elevational side view similar to FIG. 2 but showing the roll slicing mechanism in a retracted position.

Through rotation of the arm 33, the roll breaking mechanism 37 can move between an operational position shown in FIGS. 1–3, in which the rim 44 of wheel 43 is engaging the further disk-like portion 20B of the pulley 20 and the ends 52 and 53 of the spindles 41 and 42 are a small distance above the outer peripheral edge of the knife 22, and a retracted position shown in FIG. 4, in which the rim 44 of wheel 43 is spaced from further disk-like portion 20B of the pulley 20 and the ends 52 and 53 of the spindles are spaced above the knife so that a roll cluster 12 can pass beneath the roll breaking mechanism 37 without engagement therewith. Rim 44 of wheel 43 and shaft 18 comprise a responsive means that is responsive to movement of roll breaking mechanism 37 between the operational and retracted positions. The spindles preferably rotate in the directions shown by respective arrows 55A and 55B in FIG. 5, so that the ends 52 and 53 urge adjacent rolls apart as the rolls first contact spindle ends 52 and 53.

Referring to FIG. 3, the bar 26 has secured to its rear end an upright support 57, and has secured to its front end a further upright support 58. A transverse rod 59 is fixedly secured to the upper end of the support 58, and projects horizontally outwardly in a direction opposite from the direction in which axles 28 and 29 project outwardly from bar 26. An elongate arm 62 has one end pivotally secured to the plate 40 on support block 38 by a bolt 63 that engages a threaded hole in plate 40, and the underside of the arm 62 slidably rests on the rod 59. A metal strip 64 bent to form a loop has its ends supported on the bolt 63, and a helical expansion spring 67 has its ends supported by the metal loop 64 and the support 57, so as to urge the arm 33 to rotate clockwise in FIG. 3, which in turn urges downward movement of the roll breaking mechanism 37 toward its operational position.

An L-shaped handle 68 (FIG. 1) is welded to the front end of the arm 62. A recess 71 is provided in the underside of arm 62, and has a semicircular end portion 72 at its front end. When the roll breaking mechanism 37 is in the operational position of FIGS. 1–3, the handle 68 can be manually grasped and pulled forwardly against the urging of spring 67, thereby causing the arm 33 to rotate counterclockwise in FIG. 3 as the roll breaking mechanism moves toward its retracted position. When the rod 59 reaches and moves into the recess 71, the roll breaking mechanism 37 is in its retracted position of FIG. 4. Engagement of the rod 59 with the semi-circular end 72 of the recess 71 prevents the spring 67 from returning the roll breaking mechanism 37 to its operational position. Later, the handle 68 can be manually grasped, lifted a small amount, and then allowed to gradually move rearwardly, so that the spring 67 can return the roll breaking mechanism 37 to its operational position.

The structure and function of the roll breaking mechanism 37 is generally conventional, and in particular is very similar to that disclosed in U.S. Pat. No. 4,049,171, which names the same inventor as the present application. There is, however, one significant difference between the roll breaking mechanism disclosed in the present application and that in the prior patent. In particular, when viewed from the side, the spindles of the pre-existing roll breaking mechanism had axes of rotation which were substantially vertical in the operational position, and in particular did not deviate from the vertical by more than five degrees. In contrast, with reference to FIG. 2 of the present application, the preferred embodiment of the present invention has axes of rotation 76 for the spindles which, when viewed from the side, form an angle 78 in the range of 10° to 25° with respect to a vertical reference 77, and preferably about 15°. In this regard, the rotational axes 76 extend downwardly and rearwardly at an angle 78 of about 15° with respect to the vertical reference 77.

In operation, the chisel-shaped end portions 52 and 53 of the spindles break apart the joint between a pair of adjacent rolls above the location where the knife 22 is creating a slice, in order to provide clearance between the pair of rolls for passage of the shaft 18 therethrough as the roll cluster 12 moves the past the knife 22 and is sliced from end to end by the knife.

Figure 6:
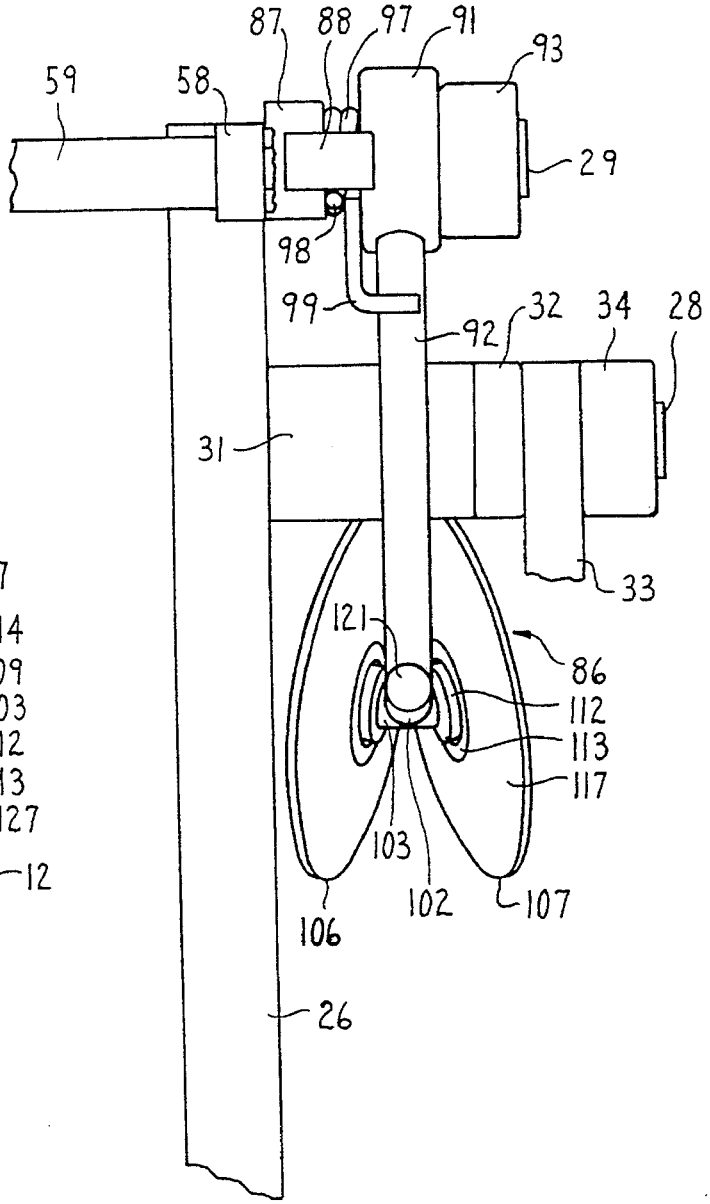
FIG. 6 is a top view of a roll spreading mechanism which is a component of the roll slicing mechanism of FIG. 1.

As best seen in FIGS. 1 and 6, the axle 29 extends successively through a sleeve 87 which has an L-shaped spring support secured to it and which is held against rotation by a screw stud 89, a loop in a torsion spring 97, a sleeve 91 which is rotatable on the axle 29 and has secured to it a radially outwardly projecting rod 92, and a sleeve 93 which is held against rotational movement on the axle 29 by a screw stud 94. The torsion spring 97 has a first leg 98 engaging the spring support 88 and a second leg 99 engaging the rod 92, so that the rod 92 is urged to pivot downwardly.

The rod 92 supports a roll spreading and positioning mechanism 86. In particular, the radially outer end of the rod 92 is welded to a central portion of an approximately vertically extending rod 102, which is part of the roll spreading and positioning mechanism 86. The lower end of the rod 102 is welded to the central portion of a further rod or axle 103, which is bent so that its end portions extend slightly forwardly and downwardly from the central portion. Respective wheel and bearing assemblies 106 and 107 are supported on respective ends of the axle 103, and are held in place by respective push nuts 108 and 109. The wheel and bearing assemblies 106 and 107 are identical, and therefore only the assembly 107 is described in detail.

Figure 7:
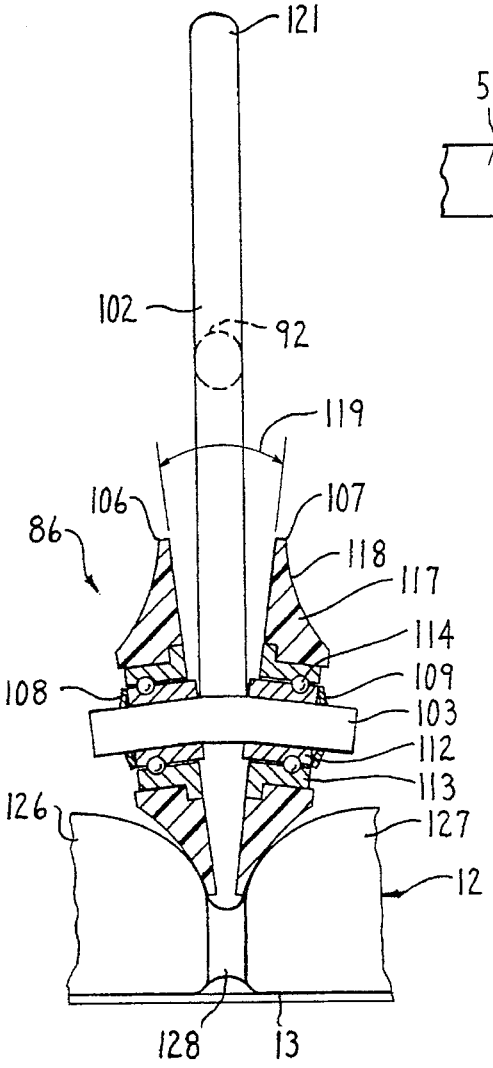
FIG. 7 is a sectional rear view of the roll spreading mechanism.

More specifically, as shown in FIG. 7, the assembly 107 includes a sleeve-like cylindrical metal race means, which comprises inner race 112, outer race 113, and push nut 109. Inner race 112 encircles an end portion of the axle 103 and has one axial end disposed against the rod 102. Push nut 109 engages the opposite axial end of inner race 112 in order to hold the assembly 107 on the axle 103. A sleeve-like metal outer race 113 of L-shaped cross section encircles the inner race, and a plurality of metal ball bearings 114 disposed between the races engage circumferential grooves provided in the facing surfaces of the races. The axial length of the outer race 113 is slightly less than that of the inner race 112, so that the outer race 113 does not engage and rub against the rod 102.

The assembly 107 further includes an annular plastic wheel section 117 which encircles and is fixedly mounted on the outer race 113. The outwardly facing surface 118 of the wheel section 117 is concave, and has an approximately arcuate curvature when viewed in cross section (FIG. 7). The wheel section 117 tapers progressively in cross-sectional thickness toward its outer end, and has a relatively small axial thickness adjacent its outer end. Due to the fact that the axle 103 is bent, the wheel assemblies 106 and 107 form an angle 119 of approximately 20° with respect to each other, and in particular converge downwardly and forwardly to edge portions which are closely adjacent.

FIG. 2 shows the roll spreading and positioning mechanism 86 in its operational position, in which the lowermost portions of the wheel and bearing assemblies 106 and 107 are at approximately the same vertical height as the knife 22, and in alignment with the shaft 18 along the direction 14 of conveyor movement. The rod 92 engages the sleeve 31 on axle 28 to limit downward movement of the spreading and positioning mechanism 86. If, as already described above, the arm 62 is manually moved in order to rotate the support block 38 and arm 33 clockwise in FIG. 2 from the operational position to the retracted position, the plate 40 engages an upper end 121 of the rod 102 and pivots the rod 92 and the spreading and positioning mechanism 86 clockwise in FIG. 2 about axle 29 from the operational position of FIG. 2 to a retracted position shown in FIG. 4. Similarly, when the support block 38 and arm 33 are thereafter manually returned to the operational position of FIG. 2, the torsion spring 97 automatically pivots the rod 92 and the spreading and positioning mechanism 86 from the retracted position of FIG. 4 back to the operational position of FIG. 2.

With reference to FIG. 7, when a roll cluster 12 on the conveyor 13 reaches and passes the spreading and positioning mechanism 86, the adjacent edges of the wheel sections 117 move into the region above a joint 128 and between two rolls 126 and 127 of the cluster. If necessary, the spreading and positioning mechanism 86 can move upwardly a small distance by rotating rod 92 and sleeve 91 a small amount against the urging of torsion spring 97, so that the wheel sections can literally roll over the roll cluster. Due to the fact that the wheel sections diverge in a rearward direction as well as an upward direction, as best seen in FIG. 6, they will urge the rolls 126 and 127 away from each other (without destroying the joint 128) as the rolls move past them, so that the spindles of the roll breaking mechanism 37 will thereafter break apart only the upper portion of the joint 128 and will not tear up portions of the rolls 126 and 127 themselves. It will thus be recognized that the wheel sections not only spread the rolls 126 and 127, but also act to transversely position them for optimum engagement by the roll breaking mechanism 37 and ultimately the slicing knife 22 on shaft 18.

Although a single preferred embodiment of the invention has been shown and described in detail for illustrative purposes, it will be recognized that there are variations or modifications of the preferred embodiment, including the rearrangement of parts, which lie within the scope of the present invention.

The embodiments of the invention in which an exclusive property or privilege is claimed are defined as follows:

1. A roll slicing apparatus, comprising: conveyor means for supporting and effecting movement in a first direction of a roll cluster which includes a pair of rolls separably joined at a joint and spaced in a second direction substantially perpendicular to said first direction, each roll having a top and bottom; roll slicing means for simultaneously slicing the rolls of the pair between said top and bottom the roll slicing means, including a rotatably supported shaft extending in a third direction substantially perpendicular to said first and second directions and having at an end nearest said conveyor means a disk knife extending approximately parallel to said first and second directions; drive means for effecting rotation of said shaft; roll breaking means positioned in a fourth direction from said shaft in feeding alignment with said shaft for breaking apart said pair of rolls along a joint therebetween and above a slice made by said knife to provide clearance for passage of said shaft between said rolls, said fourth direction being opposite said first direction; and spreading means positioned in said fourth direction from said roll breaking means in feeding alignment with the spreading means for urging the rolls of the pair away from each other in directions parallel to said second direction prior to engagement of said roll breaking means with the rolls, and said spreading means being supported for movement toward and away from said conveyor means in directions approximately parallel to said shaft, and said spreading means includes a means for yieldably urging said spreading means toward said conveyor means.

2. An apparatus according to claim 1, further comprising a movement support means for movably supporting said roll breaking means toward and away from said conveyor means in directions approximately parallel to said shaft thus moving said roll breaking means between operational and retracted positions, and a means responsive to movement of said roll breaking means, between said operational and retracted positions, for effecting movement of said spreading means between operational and retracted positions.

3. An apparatus according to claim 1, wherein said spreading means includes first and second rotatably supported wheels which are oriented to converge in a direction approximately toward said conveyor means.

4. An apparatus according to claim 3, wherein said first and second wheels are oriented to also converge in said fourth direction.

5. An apparatus according to claim 4, wherein said first and second wheels converge at an angle of approximately 20° with respect to each other.

6. An apparatus according to claim 4, wherein said first and second wheels are each freely rotatable.

7. An apparatus according to claim 4, wherein said first and second wheels each have a cross sectional shape which tapers in axial thickness toward a radially outer edge.

8. An apparatus according to claim 4, wherein said spreading means includes a first rod extending radially of and rotatable about an axis substantially parallel to said second direction; a second rod extending approximately in said third direction and having a central portion fixedly secured to a radially outer end of said first rod; a third rod extending approximately in said second direction, having a central portion fixedly secured to an end of said second rod nearest said conveyor, and having end portions bent to extend slightly toward said conveyor and in said fourth direction; each said wheel being rotatably supported on a respective said end portion of said third rod.

9. An apparatus according to claim 8, wherein each wheel includes a ball bearing and race means, which are disposed on each end portion of said third rod and which have axial ends engaging said second rod and a push nut, each wheel further including an annular wheel section encircling and supported by said ball bearing.

10. An apparatus according to claim 3, wherein each of said first and second wheels has, adjacent a radially outer edge thereof and on a side opposite from the other of said first and second wheels, an annular surface of concave cross-sectional shape.

11. An apparatus according to claim 10, wherein said annular surface of concave cross-sectional shape on each said wheel has an arcuate cross-sectional shape.

* * * * *

UNITED STATES PATENT AND TRADEMARK OFFICE

CERTIFICATE OF CORRECTION

PATENT NO. : 5 592 865

DATED : January 14, 1997

INVENTOR(S) : Dale S. Lecrone

It is certified that error appears in the above-indentified patent and that said Letters Patent is hereby corrected as shown below:

Column 7, lines 11 and 12; change "bottom the roll slicing means," to ---bottom, the roll slicing means---.

Signed and Sealed this

Tenth Day of June, 1997

Bruce Lehman

*Attest:*

BRUCE LEHMAN

*Attesting Officer*

*Commissioner of Patents and Trademarks*